US009943878B2

(12) United States Patent
Yomo et al.

(10) Patent No.: US 9,943,878 B2
(45) **Date of Patent: *Apr. 17, 2018**

(54) COATING METHOD AND COATED ARTICLE OBTAINED BY THE SAME

(71) Applicant: TOYOTA JIDOSHA KABUSHIKI KAISHA, Toyota-shi, Aichi (JP)

(72) Inventors: Shuji Yomo, Nagakute (JP); Kazuyuki Tachi, Nagakute (JP); Hisao Hayashi, Nagakute (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/106,351

(22) PCT Filed: Dec. 12, 2014

(86) PCT No.: PCT/JP2014/083628
§ 371 (c)(1),
(2) Date: Jun. 20, 2016

(87) PCT Pub. No.: WO2015/114990
PCT Pub. Date: Aug. 6, 2015

(65) Prior Publication Data

US 2017/0036240 A1 Feb. 9, 2017

(30) Foreign Application Priority Data

Jan. 30, 2014 (JP) ..... 2014-015147

(51) Int. Cl.
*B05D 3/02* (2006.01)
*B05D 7/00* (2006.01)
*B05D 1/36* (2006.01)

(52) U.S. Cl.
CPC ..... *B05D 3/0254* (2013.01); *B05D 1/36* (2013.01); *B05D 7/532* (2013.01); *B05D 7/542* (2013.01); *B05D 2502/00* (2013.01); *B05D 2502/005* (2013.01); *B05D 2508/00* (2013.01)

(58) Field of Classification Search
None
See application file for complete search history.

(56) References Cited

U.S. PATENT DOCUMENTS

| | | | | |
|---|---|---|---|---|
| 5,556,527 A * | 9/1996 | Igarashi | B05D 5/066 | 204/487 |
| 7,658,017 B1 * | 2/2010 | Laviolette | F26B 5/042 | 34/403 |
| 2010/0136342 A1 * | 6/2010 | Tachi | B05D 3/0254 | 428/411.1 |
| 2011/0177348 A1 | 7/2011 | Yomo et al. | | |

FOREIGN PATENT DOCUMENTS

| | | |
|---|---|---|
| JP | 2007-229671 A | 9/2007 |
| JP | 2007-283271 A | 11/2007 |
| JP | 2010-82535 A | 4/2010 |
| JP | 2010-142712 A | 7/2010 |

* cited by examiner

*Primary Examiner* — Michael P Rodriguez
(74) *Attorney, Agent, or Firm* — Sughrue Mion, PLLC

(57) ABSTRACT

A coating method for forming a laminated coating film including a lower layer formed on a base material and an upper layer formed on the lower layer including: preparing a thermosetting coating material as a lower layer-coating material and preparing a thermosetting coating material as an upper layer-coating material; forming an uncured laminated coating film by applying the lower layer-coating material and the upper layer-coating material on the base material using a wet-on-wet technique; and simultaneously curing the lower layer-coating material and the upper layer-coating material by baking the uncured laminated coating film. In the preparation step, the lower layer-coating material and the upper layer-coating material are selected so that an absolute value of a difference in shrinkage ratio between the lower layer and the upper layer coating materials is 2.0% or smaller at a late stage of the baking step.

5 Claims, No Drawings

COATING METHOD AND COATED ARTICLE OBTAINED BY THE SAME

CROSS REFERENCE TO RELATED APPLICATIONS

This application is a National Stage of International Application No. PCT/JP2014/083628 filed Dec. 12, 2014, claiming priority based on Japanese Patent Application No. 2014-015147, filed Jan. 30, 2014, the contents of all of which are incorporated herein by reference in their entirety.

TECHNICAL FIELD

The present invention relates to a coating method in which two kinds of coating materials are applied using a wet-on-wet technique and then simultaneously baked, and to a coated article obtained by the same.

BACKGROUND ART

For forming a laminated coating film by a coating method in which two kinds of coating materials are applied using a wet-on-wet technique and then baked, there has been a conventionally used method by which the laminated coating film as a whole is cured. In this method, thermosetting coating materials for forming layers constituting a laminated coating film are selected so that all the layers can be cured at the same heating temperature after all the coating materials are applied. However, the conventional coating method has a problem that the obtained laminated coating film is inferior in surface texture and gloss to that obtained by baking a lower layer and then applying and baking a coating material for forming an upper layer. In this connection, various methods have been proposed to improve the surface texture and the gloss of a laminated coating film.

For example, Japanese Unexamined Patent Application Publication No. 2007-283271 (PTL 1) discloses a method for forming a multilayer coating film, the method comprising: forming a base coat film on a workpiece by applying a water-based colored base coating material containing an amino resin such as melamine as a cross-linking agent; applying and stacking a water-based clear coating material containing a polyisocyanate compound as a cross-linking agent on the base coat film remaining in an uncured state using a wet-on-wet technique; and subsequently curing the base coat film and the clear coat film together by heating, wherein the solid content concentration and the water absorption percentage of the base coat film at the application of the clear coating material are set within certain ranges, i.e., the solid content concentration of the base coat film is 85% by mass or higher, and the water absorption percentage of the base coat film at 20° C. is 10% by mass or less. PTL 1 also discloses an article coated by the method for forming a multilayer coating film. However, in the case of the conventional method for forming a multilayer coating film and the article coated by the method as described in PTL 1, the appearance qualities, such as surface texture (smoothness) and gloss, of the laminated coating film are not necessarily sufficient, and it is difficult to improve the surface texture and gloss to the levels required for the appearance qualities of automobiles. In this respect, coated articles having better appearance qualities and better durability have been demanded for automobile steel plates and the like, and further improvement of the wet-on-wet coating method has been desired.

CITATION LIST

Patent Literature

[PTL 1] Japanese Unexamined Patent Application Publication No. 2007-283271

SUMMARY OF INVENTION

Technical Problem

The present invention has been made in view of the above-described problems of the conventional technologies. An object of the present invention is to provide a coating method which makes it possible to obtain a laminated coating film having an upper layer in which formation of surface unevenness is sufficiently suppressed, even when two kinds of coating materials are applied using a wet-on-wet technique and simultaneously baked to cure the layers. Another object of the present invention is to provide a coated article that is obtained by the same and is very excellent in appearance qualities.

Solution to Problem

The present inventers have conducted earnest study to achieve the above object, and consequently revealed the following fact in the case where coating is conducted by applying two kinds of thermosetting coating materials using a wet-on-wet technique and simultaneously baking them. Specifically, a thermosetting coating material is used as a lower layer-coating material for forming the lower layer, and a thermosetting coating material is used as an upper layer-coating material for forming the upper layer. Here, these coating materials are selected so that an absolute value of a difference in shrinkage ratio between the lower layer-coating material and the upper layer-coating material can be within a specific range at the late stage of the baking in the baking step. Use of such coating materials makes it possible to reduce the amount of transfer of the unevenness at the interface between the upper layer and the lower layer to the upper layer which has been cured with fluidity remarkably lowered. Accordingly, a laminated coating film having further very excellent appearance qualities can be obtained, even though the two kinds of coating materials are applied using a wet-on-wet technique and then simultaneously baked. This finding has led to the completion of the present invention.

The coating method of the present invention is a coating method for forming a laminated coating film including a lower layer formed on a base material and an upper layer formed on the lower layer, the coating method comprising:

a preparation step of preparing a thermosetting coating material as a layer-coating material for forming the lower layer and preparing a thermosetting coating material as an upper layer-coating material for forming the upper layer;

a formation step of forming an uncured laminated coating film by applying the lower layer-coating material and the upper layer-coating material on the base material using a wet-on-wet technique; and a baking step of simultaneously curing the lower layer-coating material and the upper layer-coating material by subjecting the uncured laminated coating film to a baking treatment, wherein in the preparation step, the lower layer-coating material and the upper layer-coating material are selected so that an absolute value of a difference in shrinkage ratio between the lower layer-coating material and the upper layer-coating material is 2.0% or smaller at a late stage of the baking in the baking step.

In the above-described coating method of the present invention, the upper layer-coating material preferably has a shrinkage ratio in a range from 0 to 20% at the late stage of the baking in the baking step, and the lower layer-coating material preferably has a shrinkage ratio in a range from 0 to 20% at the late stage of the baking in the baking step.

In addition, in the above-described coating method of the present invention, the upper layer-coating material is preferably a coating material containing no melamine resin as a curing agent.

Moreover, in the above-described coating method of the present invention, the upper layer-coating material is preferably a thermosetting coating material from which no volatile product is formed in a curing reaction by a heat treatment.

Further, in the above-described coating method of the present invention, each of the upper layer-coating material and the lower layer-coating material preferably contains a thermosetting resin and a curing agent, a combination of the thermosetting resin and the curing agent in the upper layer-coating material is preferably a combination selected from the group consisting of a combination of a hydroxy group-containing acrylic resin and an isocyanate compound, a combination of a hydroxy group-containing acrylic resin and an isocyanate resin, and a combination of a hydroxy group and glycidyl group-containing acrylic resin and a carboxyl group-containing acrylic resin, and a combination of the thermosetting resin and the curing agent in the lower layer-coating material is preferably a combination selected from the group consisting of a combination of an acrylic resin and a melamine resin, a combination of a polyester resin and a melamine resin, a combination of an acrylic resin and a (block) isocyanate compound, and a combination of a polyester resin and a (block) isocyanate compound.

Furthermore, in the above-described coating method of the present invention, the upper layer-coating material is preferably a clear coating material, and the lower layer-coating material is preferably a base coating material.

The coated article of the present invention comprises a laminated coating film including a lower layer formed on a base material and an upper layer formed on the lower layer, wherein the coated article is obtained by the above coating method.

Note that, although it is not known exactly why the above-described object is achieved by the present invention, the present inventors speculate as follows. Specifically, in a conventional laminated coating film formed using a wet-on-wet technique, thermosetting coating materials are used for all layers including an upper layer, and the laminated coating film is designed so that these layers are simultaneously cured at the same heating temperature, or curing is started sequentially from a lower layer. Accordingly, when the thermosetting coating material for forming the upper layer is cured by a heat treatment (baking treatment), curing of the thermosetting coating material proceeds also in the lower layer of the upper layer, and the layer already loses the fluidity. In each layer of the laminated coating film, the thermosetting coating material is cured by a condensation reaction or by an addition reaction after the deblocking reaction of a curing agent. Accordingly, volatile products formed in this condensation reaction or deblocking reaction evaporate along with the residual solvents. This causes the shrinkage of the laminated coating film, and thereby unevenness is formed on the surface of the coating film. This surface unevenness of the coating film is reduced by the flowing or the like of the upper layer that keeps having sufficient fluidity. However, the present inventors speculate that, when the fluidity of the upper layer remarkably decreases because of the curing, the unevenness on the surface of the base material or at each interface between layers is transferred to the surface of the upper layer, deteriorating the surface texture and the gloss of the laminated coating film.

Also in a case where a thermosetting coating material containing an isocyanate compound or an isocyanate resin as a curing agent is used as an upper layer-coating material or the like, the upper layer often loses the fluidity before the lower layer is cured, because of the higher curing rate of the upper layer-coating material. In this case, the curing of the lower layer proceeds, after the upper layer is cured. Since the lower layer-coating material used for conventional wet-on-wet application has poor fluidity, the unevenness formed because of the shrinkage which occurs when the curing of the lower layer proceeds is not sufficiently reduced, and the unevenness on the surface of the base material or at each interface between layers is transferred to the surface of the upper layer. Presumably because of this, the surface texture and the gloss of the laminated coating film deteriorate.

To achieve the above-described object, the present inventors have first focused on the fact that the appearance qualities such as surface texture (smoothness) and gloss of the laminated coating film are better, when the upper layer has less surface unevenness. Then, the present inventors have found that the unevenness which has an influence on the surface texture is attributable to the non-uniformity of the amount of the coating material applied on the surface of the base material during spraying and the amount of shrinkage of the coating film during the drying step (including the baking step) in the direction of the surface, while the unevenness (corresponding to shorter wavelengths than those in the case of the surface texture) which governs the gloss is attributable to the non-uniformity of the amount of shrinkage of the coating film in the drying step in the direction of the surface. In addition, of the two types of the unevenness formed because of the above-described two factors, the unevenness attributable to the non-uniformity of the amount of the coating material applied on the surface of the base material during the spraying in the direction of the surface can be suppressed by improving the fineness of particles of the coating material. However, this causes deterioration in coating efficiency, which is an effective utilization rate of the coating material. Hence, the improvement in the fineness of particles of the coating material more than necessary is not favorable in terms of costs and the like. For this reason, it has been found that, to improve the appearance qualities such as surface texture (smoothness) and gloss, the reduction of the unevenness attributable to the non-uniformity of the amount of shrinkage of the coating film in the direction of the surface in the drying step is advantageous. Then, the present inventors have found the following fact. Specifically, when a laminated coating film is formed by applying a coating material for forming a lower layer and a coating material for forming an upper layer on a base material using a wet-on-wet technique and then simultaneously baking the coating materials, the above-described unevenness is formed mainly because the unevenness at the interface located between the lower layer and the upper layer and formed when the lower layer-coating material and the upper layer-coating material are applied using a wet-on-wet technique is transferred to the surface of the upper layer because of the shrinkage of the layers, after the remarkable lowering of the fluidity of the upper layer in the drying step. Hence, if the difference in shrinkage ratio between the layers forming the interface is small, the amount of the unevenness at the interface transferred to the surface of the upper layer is small.

In this respect, in a case where coating is carried out by applying two kinds of thermosetting coating materials using a wet-on-wet technique, and simultaneously baking these materials, a thermosetting coating material is used as the lower layer-coating material for forming the lower layer, and a thermosetting coating material is used as the upper layer-coating material for forming the upper layer. Here, these coating materials are selected so that an absolute value of a difference in shrinkage ratio between the lower layer-coating material and the upper layer-coating material at a late stage of the baking in the baking step is 2.0% or smaller, and the absolute value of the difference in shrinkage ratio between the lower layer and the upper layer is sufficiently reduced within a specific range. The present inventors speculate that this makes it possible to sufficiently reduce the unevenness at the interface between the upper layer and the lower layer and the amount of the unevenness transferred to the upper layer, so that a laminated coating film having further very excellent appearance qualities can be obtained, even when two kinds of coating materials are applied using a wet-on-wet technique and then simultaneously baked.

Advantageous Effects of Invention

According to the present invention, even when two kinds of coating materials are applied using a wet-on-wet technique and are baked to cure all the layers, a laminated coating film having an upper layer in which formation of surface unevenness is sufficiently suppressed can be obtained. Accordingly, the present invention makes it possible to obtain a coated article having very excellent appearance qualities such as surface texture (surface smoothness) and gloss.

DESCRIPTION OF EMBODIMENTS

Hereinafter, the present invention will be described in details on the basis of preferred embodiments thereof.

A coating method of the present invention is a coating method for forming a laminated coating film including a lower layer formed on a base material and an upper layer formed on the lower layer, the coating method comprising:

a preparation step (Raw Coating Material Preparation Step) of preparing a thermosetting coating material as a lower layer-coating material for forming the lower layer and preparing a thermosetting coating material as an upper layer-coating material for forming the upper layer;

a formation step (Application Step) of forming an uncured laminated coating film by applying the lower layer-coating material and the upper layer-coating material on the base material using a wet-on-wet technique; and a baking step (Baking Step) of simultaneously curing the lower layer-coating material and the upper layer-coating material by subjecting the uncured laminated coating film to a baking treatment, wherein in the preparation step, the lower layer-coating material and the upper layer-coating material are selected so that an absolute value of a difference in shrinkage ratio between the lower layer-coating material and the upper layer-coating material is 2.0% or smaller at a late stage of the baking in the baking step.

(Raw Coating Material Preparation Step)

In the coating method of the present invention, first, a lower layer-coating material for forming the lower layer and an upper layer-coating material for forming the upper layer are prepared.

A thermosetting coating material is used as the upper layer-coating material according to the present invention. The thermosetting coating material used as the upper layer-coating material only needs to be one containing a thermosetting resin capable of forming a coating film and a curing agent, and examples thereof include thermosetting coating materials used as upper layer-coating materials for ordinary baking finish. The form of the thermosetting coating material for the upper layer may be any of solvent-based form, water-based form, and powder form. A curing temperature of the thermosetting coating material for the upper layer is not particularly limited, and is generally 40 to 200° C., and preferably 80 to 160° C. Note that, as the upper layer-coating material, it is preferable to use a coating material having a weight loss percentage of 0 to 20% by mass at the curing temperature thereof. This leads to a tendency to minimize the shrinkage of the coating film due to a heat treatment. Moreover, from such a viewpoint, it is the most preferable to use a coating material having a weight loss percentage of 0 to 10% by mass.

Note that, in the present invention, the curing temperature of a coating material refers to a temperature at which the coating material can be cured most efficiently in relation to other curing conditions such as curing time, in the case where a target coating material is applied to the base material, heat treatment is performed, and the coating film is cured to be fixed on the base material. In general, the curing temperature refers to a baking temperature which is set (designed) for each coating material. In the present invention, a value listed in its catalog can be employed as this curing temperature (baking temperature).

Examples of the thermosetting resin that is contained in the upper layer-coating material and is capable of forming a coating film include hydroxy group-, glycidyl group-, or carboxyl group-containing acrylic resins, polyester resins, alkyd resins, epoxy resins, and urethane resins; however, the thermosetting resin is not limited thereto. Preferable curing agents include isocyanate compounds, block isocyanate compounds, isocyanate resins, and amino compounds; however, the curing agent is not limited thereto. In addition, one of these thermosetting resins may be used alone, or two or more thereof may be used in combination. Also, one of these curing agents may be used alone, or two or more thereof may be used in combination.

Note that, preferably, the curing agent contained in the upper layer-coating material does not contain any melamine resin. This leads to a tendency to minimize the shrinkage of the coating film due to a heat treatment.

In addition, the upper layer-coating material is preferably a thermosetting coating material from which no volatile product is formed in a curing reaction by a heat treatment. This leads to a tendency to minimize the shrinkage of the coating film due to a heat treatment.

Further, examples of combinations of the thermosetting resin and the curing agent from which no volatile product is formed in the curing reaction by the heat treatment include combinations of a hydroxy group-containing acrylic resin with an isocyanate compound and/or an isocyanate resin, and the like. In the present invention, to obtain further excellent and high appearance qualities, a thermosetting coating material to be cured by a heat treatment may be applied on the upper layer of the laminated coating film cured by being subjected to the heat treatment. This thermosetting coating material is more preferably a coating material from which substantially no volatile product is formed in the curing reaction by the heat treatment.

Note that, in the present invention, the upper layer-coating material is prepared by selecting a combination of the thermosetting resin and the curing agent to be contained in the upper layer-coating material, so that an absolute value of a difference in shrinkage ratio between the lower layer-coating material and the upper layer-coating material is within the above-described range at a late stage of the baking in the baking step. The combination of the thermosetting resin and the curing agent is preferably a combination of a hydroxy group-containing acrylic resin and an isocyanate compound, a combination of a hydroxy group-containing acrylic resin and an isocyanate resin, or a combination of a hydroxy group and glycidyl group-containing acrylic resin and a carboxyl group-containing acrylic resin.

Moreover, the upper layer-coating material is preferably a so called "clear coating material" for forming a clear coating film (clear layer) used for automobile coating material and coating. The clear coating material may be, for example, one containing a thermosetting resin, an organic solvent, and if necessary, an ultraviolet absorber or the like and being capable of forming a transparent coating film. Examples of the thermosetting resin include those containing a resin, such as an acrylic resin, a polyester resin, an alkyd resin, a fluororesin, a urethane resin, or a silicon-containing resin, having a cross-linkable functional group such as a hydroxy group, a carboxyl group, a silanol group, or an epoxy group and a cross-linking agent which is capable of reacting with the cross-linkable functional group, such as a melamine resin, a urea resin, a (block) polyisocyanate compound, an epoxy resin compound or resin, a carboxyl group-containing compound or resin, an acid anhydride, or an alkoxysilane group-containing compound or resin.

In addition, the upper layer-coating material of the present invention may contain conventionally known coloring pigments, effect or luster pigments, and the like within a conventionally known scope, when needed. Meanwhile, in order to adjust various properties, various additives such as a viscosity controlling agent, a surface conditioner, a thickening agent, an antioxidant, an ultraviolet absorber, and a defoamer may be blended within a conventionally known scope.

As the lower layer-coating material according to the present invention, a thermosetting coating material is used. The thermosetting coating material used as the lower layer-coating material only needs to contain a thermosetting resin capable of forming a coating film and a curing agent, and examples thereof include thermosetting coating materials used as lower layer-coating materials for ordinary baking finish. The form of the thermosetting coating material for the lower layer may be any of solvent-based form, water-based form, and powder form. The curing temperature of the thermosetting coating material for the lower layer is not particularly limited, and is generally 40 to 200° C., and preferably 80 to 160° C.

Examples of the thermosetting resin that is capable of forming a coating film contained in the lower layer-coating material include acrylic resins, polyester resins, alkyd resins, epoxy resins, and urethane resins; however, the thermosetting resin is not limited thereto. Examples of the curing agent include amino compounds, amino resins, isocyanate compounds, block isocyanate compounds, and isocyanate resins; however, the curing agent is not limited thereto. In addition, one of these thermosetting resins may be used alone, or two or more thereof may be used in combination. Also, one of these curing agents may be used alone, or two or more thereof may be used in combination.

Note that, in the present invention, the lower layer-coating material is prepared by selecting a combination of the thermosetting resin and the curing agent contained in the lower layer-coating material, so that an absolute value of a difference in shrinkage ratio between the lower layer-coating material and the upper layer-coating material is within the above-described range at the late stage of the baking in the baking step. The combination of the thermosetting resin and the curing agent is preferably a combination of an acrylic resin and a melamine resin, a combination of a polyester resin and a melamine resin, a combination of an acrylic resin and a (block) isocyanate compound, or a combination of a polyester resin and a (block) isocyanate compound.

Moreover, the lower layer-coating material is preferably a so called "base coating material" for forming a base coating film (base layer) used for automobile coating material and coating. For example, known solvent-based colored base coating materials and water-based colored base coating material are preferably used. Examples of the water-based colored base coating materials include those containing a pigment, a water-soluble or dispersible resin, a cross-linking agent, if necessary, and water serving as a solvent. The water-soluble or dispersible resin may be, for example, a resin having a hydrophilic group such as a carboxyl group and a cross-linkable functional group such as a hydroxy group in a single molecule, and specific examples thereof include acrylic resins, polyester resins, polyurethane resins, and the like. Meanwhile, examples of the cross-linking agent include hydrophobic or hydrophilic alkyl ether melamine resins, block isocyanate compounds, and the like. Meanwhile, examples of the solvent-based colored base coating materials include those containing a pigment, a resin as described above, a cross-linking agent, if necessary, and a solvent.

In addition, the lower layer-coating material of the present invention may contain conventionally known coloring pigments, effect or luster pigments, and the like within a conventionally known scope, when needed. Meanwhile, in order to adjust various properties, various additives such as a viscosity controlling agent, a surface conditioner, a thickening agent, an antioxidant, an ultraviolet absorber, and a defoamer may be blended within a conventionally known scope.

Note that, in the raw coating material preparation step of the present invention, it is necessary to select the lower layer-coating material and the upper layer-coating material, so that an absolute value of a difference in shrinkage ratio between the lower layer-coating material and the upper layer-coating material is 2.0% or smaller at the late stage of the baking in the baking step described later.

Regarding the upper layer-coating material and the lower layer-coating material, the upper layer-coating material preferably has a shrinkage ratio in a range from 0 to 20% at the late stage of the baking in the baking step, and the lower layer-coating material preferably has a shrinkage ratio in a range from 0 to 20% at the late stage of the baking in the baking step. This leads to a tendency that a laminated coating film having an upper layer with less surface unevenness can be obtained, and consequently it tends to be possible to obtain a coated article having very excellent appearance qualities such as surface texture (surface smoothness) and gloss.

Regarding the upper layer-coating material and the lower layer-coating material, the upper layer-coating material is preferably a coating material of an acid-epoxy curing system, an isocyanate-curing system, or a melamine-curing system, and the lower layer-coating material is preferably a coating material of a melamine-curing system or an isocyanate-curing system.

Further, the combination of the upper layer-coating material and the lower layer-coating material is more preferably such that the upper layer-coating material/lower layer-coating material is acid-epoxy curing system/melamine-curing system, acid-epoxy curing system/isocyanate-curing system, isocyanate-curing system/melamine-curing system, or isocyanate-curing system/isocyanate-curing system.

(Application Step)

Next, in the coating method of the present invention, an uncured laminated coating film is formed by applying, on the base material, the lower layer-coating material and the upper layer-coating material prepared in the raw coating material preparation step using a wet-on-wet technique.

The base material according to the present invention is not particularly limited, and examples thereof include metal materials such as iron, aluminum, brass, copper, stainless steel, tinplate, zinc-plated steel, and alloyed-zinc (Zn—Al, Zn—Ni, Zn—Fe, or the like) plated steel; resins such as polyethylene resin, polypropylene resin, acrylonitrile-butadiene-styrene (ABS) resin, polyamide resin, acrylic resin, vinylidene chloride resin, polycarbonate resin, polyurethane resin, and epoxy resin; various plastic materials such as FRPs; inorganic materials such as glass, cement, and concrete; wood; fiber materials (paper, fabrics, and the like); foamed materials; and the like. Of these materials, metal materials and plastic materials are preferable, and metal materials are particularly preferable. The present invention is preferably applied especially to automobile steel plates which are required to have high appearance qualities. The surfaces of these base materials may be subjected, in advance, to an electrodeposition treatment, electrodeposition and intermediate coating treatments, or the like.

In the application step according to the present invention, first, the lower layer-coating material is applied on the base material, and, if necessary, the solvent and the like are evaporated by drying or the like, to form an uncured lower layer. Subsequently, the upper layer-coating material is applied on the uncured lower layer, and, if necessary, the solvent and the like are evaporated by drying or the like, to form an uncured upper layer. Examples of methods for applying the lower layer-coating material and the upper layer-coating material include conventionally known methods such as air spray coating, air electrostatic spray coating, and rotary atomizing electrostatic coating.

Note that the film thickness of the lower layer can be appropriately set in accordance with a desired application. For example, the film thickness after the heat treatment is preferably 5 to 50 μm, and more preferably 10 to 40 μm. If the film thickness of the lower layer is less than the lower limit, it tends to be difficult to obtain a uniform coating film as the lower layer. On the other hand, if the film thickness exceeds the upper limit, there are tendencies that the lower layer absorbs a large amount of solvent and the like contained in the coating film as the upper layer, and that the evaporation of the solvent contained in the lower layer itself is prevented and thereby the appearance qualities of the laminated coating film are deteriorated.

The film thickness of the upper layer can also be appropriately set in accordance with a desired application. For example, the film thickness after the heat treatment is preferably 15 to 60 μm, and more preferably 20 to 50 μm. If the film thickness of the upper layer is less than the lower limit, the fluidity is insufficient and thereby the appearance qualities of the laminated coating film tend to be deteriorated. On the other hand, if the film thickness exceeds the upper limit, the fluidity is excessively high, and thereby defects such as sagging tend to occur in a case where the coating is performed in a vertical direction.

(Baking Step)

Next, in the coating method of the present invention, the lower layer-coating material and the upper layer-coating material are simultaneously cured by subjecting the uncured laminated coating film obtained in the application step to a baking treatment (heat treatment).

Note that, in the baking step, it is necessary that an absolute value of a difference in shrinkage ratio between the lower layer-coating material and the upper layer-coating material be 2.0% or smaller at the late stage of the baking. A conventional laminated coating film obtained using a wet-on-wet technique cannot achieve the absolute value of a difference in shrinkage ratio being 2.0% or smaller, unless the combination of the upper layer and the lower layer is deliberately selected. When the absolute value of a difference in shrinkage ratio exceeds 2.0%, it is not possible to reduce the amount of transfer of the unevenness at the interface between the upper layer and the lower layer to the upper layer which has been cured with fluidity remarkably lowered. As a result, a laminated coating film having excellent appearance qualities cannot be obtained, when the two kinds of coating materials are applied using a wet-on-wet technique and then simultaneously baked. Moreover, the absolute value of a difference in shrinkage ratio between the lower layer-coating material and the upper layer-coating material at the late stage of the baking is more preferably 1.0% or less, and particularly preferably 0.5% or less. Thus, even when two kinds of coating materials are applied using a wet-on-wet technique and are baked to cure all the layers, it tends to be possible to obtain a laminated coating film having an upper layer in which formation of surface unevenness is sufficiently suppressed. Accordingly, it tends to be possible to obtain a coated article having further very excellent appearance qualities such as surface texture (surface smoothness) and gloss.

<Method for Calculating Difference in Shrinkage Ratio>

In the present invention, the "shrinkage ratio" is defined as the shrinkage ratio measured by the following method. Specifically, since it is difficult to measure the shrinkage ratio of each layer in the state of the laminated coating film and after the remarkable lowering of the fluidity of the upper layer, the shrinkage ratios (ω') of the coating materials at the late stage of the baking are measured in the state of single-layer films of the upper layer coating film and the lower layer coating film, respectively. Here, the shrinkage ratios (ω') are attributable to the evaporation of volatile products in the curing reaction and residual solvents such as high-boiling point solvents at the late stage of the baking. Then, from the shrinkage ratios (ω'), the "absolute value of a difference in shrinkage ratio" ($|\Delta\omega'|$) between the shrinkage ratio of the lower layer-coating material and the shrinkage ratio of the upper layer-coating material at the late stage of the baking in the baking step is calculated. Note that the "shrinkage ratios" and the "absolute value of a difference in shrinkage ratio" are calculated by the following method on the basis of the weight (g) of the coating film immediately before the baking step (at the start of the baking step).

First, the upper layer-coating material (A) and the lower layer-coating material (B) are each applied on a sample base material (for example, stainless steel), so that the film thickness after the heat treatment can be the target film thickness in the laminated coating film. Then, each material is preliminarily dried (for example, dried at 60° C. for 96 hours), and then cured by heating at 140° C. for 30 minutes. Then, the weight is measured. The shrinkage ratio ω' is calculated on the basis of the formula (1):

$$\omega'=100(Y-Z)/(Z-X) \quad (1)$$

(in the formula, ω' represents the shrinkage ratio (%) mainly attributable to volatile products, X represents the weight (g) of the sample base material, Y represents the weight (g) of the sample base material and the coating film after the preliminary drying, and Z represents the weight (g) of the sample base material and the coating film after the curing by heating at 140° C. for 30 minutes).

Note that the shrinkage ratio (ω') of each of the upper layer-coating material (U) and the lower layer-coating material (L) is calculated by the corresponding one of the formulae (1-1) and (1-2):

$$\omega_U'=100(Y_U-Z_U)/(Z_U-X_U) \quad \text{(1-1), and}$$

$$\omega_L'=100(Y_L-Z_L)/(Z_L-X_L) \quad \text{(1-2).}$$

Next, the absolute value (|Δω'|) of the difference between the shrinkage ratio of the lower layer-coating film and the shrinkage ratio of the upper layer-coating film is calculated by the formula (2):

$$|\Delta\omega'|=|\omega_L'-\omega_U'| \quad (2).$$

In the present invention, the "late stage of the baking" refers to the period after the preliminary drying up to the completion of the baking. The preliminary drying refers to a state in which water has been removed by drying the coating film at 80° C. for 3 hours and then in a vacuum at 60° C. for 96 hours. The completion of the baking refers to a state in which the coating film has been baked at 140° C. for 30 minutes.

Note that, in the baking step of the present invention, the baking treatment (heat treatment) preferably includes a heat treatment at or above the temperature at which at least the upper layer is cured, for example, at or above [the curing temperature of the upper layer-coating material−20° C.]. Meanwhile, the heating time is preferably 50% or more and 150% or less of the curing time of the upper layer-coating material.

In addition, in the coating method of the present invention, to stabilize the coating film applied using a wet-on-wet technique and remaining in the uncured state, the coating film is preferably allowed to stand (flashed) at room temperature before the baking treatment (heat treatment). The flashing time is set to 1 to 20 minutes, in general.

Moreover, in the present invention, to obtain a coated article having appearance with higher quality, it is preferable to form a surface layer by further applying one kind or more of coating materials on the upper layer of the coated article obtained by the coating method and subjecting the coated article to a heat treatment. As the coating material, those listed as the examples of the upper layer-coating material can be used. In addition, examples of the method for applying the coating material include conventionally known methods such as air spray coating, air electrostatic spray coating, and rotary atomizing electrostatic coating.

A coated article of the present invention is produced by the above-described coating method of the present invention. In the coated article of the present invention, the laminated coating film has surface unevenness which is sufficiently less than that of a laminated coating film produced using a conventional wet-on-wet technique, and the coated article of the present invention has very excellent appearance qualities. In addition, the laminated coating film is formed by applying the coating material for forming the lower layer and the coating material for forming the upper layer on the base material using a wet-on-wet technique, and then simultaneously baking the materials. Thus, energy saving, cost reduction, and shortening of the process can be achieved to a great extent. In addition, when a water-based coating material using water as the major solvent is employed, emission of volatile organic compounds (VOC) can be reduced. Such a coated article is useful especially for vehicle bodies and parts for automobiles such as passenger cars, trucks, buses, and motorcycles.

EXAMPLES

Hereinafter, the present invention will be described more specifically on the basis of Examples and Comparative Examples. However, the present invention is not limited to the following Examples. Note that the shrinkage ratio of the lower layer-coating material, the shrinkage ratio of the upper layer-coating material, and the absolute value of the difference in shrinkage ratio between the lower layer-coating material and the upper layer-coating material at the late stage of the baking in the baking step were calculated by the following methods.

<Calculation of Shrinkage Ratios and Absolute Value of Difference in Shrinkage Ratio of Coating Materials at Late Stage of Baking in Baking Step>

First, each of an upper layer-coating material (A) and a lower layer-coating material (B) was applied by air spraying on weighed stainless steel foil [15 cm×3 cm×50 μm], so that the film thickness of the coating material after the heat treatment could be a target film thickness in a laminated coating film. The coated foil was dried at 80° C. for 3 hours and in a vacuum ($10^{-2}$ Torr or below) at 60° C. for 96 hours and then weighed. Further, the dried coated foil was baked at 140° C. for 30 minutes, and then weighed. The shrinkage ratio ω' was calculated on the basis of the formula (3):

$$\omega'=100(Y-Z)/(Z-X) \quad (3)$$

(in the formula, ω' represents the shrinkage ratio (%) mainly attributable to volatile products, X represents the weight (g) of the stainless steel foil, Y represents the weight (g) of the stainless steel foil and the coating film after drying at 60° C. for 96 hours in a vacuum, and Z represents the weight (g) of the stainless steel foil and the coating film after baking at 140° C. for 30 minutes).

Note that the shrinkage ratio (ω') of each of the upper layer-coating material (U) and the lower layer-coating material (L) was calculated by the corresponding one of the formulae (3-1) and (3-2):

$$\omega_U'=100(Y_U-Z_U)/(Z_U-X_U) \quad \text{(3-1), and}$$

$$\omega_L'=100(Y_L-Z_L)/(Z_L-X_L) \quad \text{(3-2).}$$

Next, the absolute value (|Δω'|) of the difference between the shrinkage ratio of the lower layer-coating film and the shrinkage ratio of the upper layer-coating film was calculated by the formula (4):

$$|\Delta\omega'|=|\omega_L'-\omega_U'| \quad (4).$$

(Synthesis Example 1) Preparation of Acrylic Emulsion R-1 for Water-Based Coating Material First, 31.5 parts by mass of 2-ethylhexyl acrylate, 78.8 parts by mass of butyl methacrylate, 37.8 parts by mass of butyl acrylate, 63.0 parts by mass of 2-hydroxyethyl methacrylate, 16.4 parts by mass of acrylic acid, 87.6 parts by mass of styrene, 3.2 parts by mass of n-dodecylmercaptan, 119 parts by mass of ion-exchanged water, and 17.5 parts by mass of LATEMUL (PD-104) were mixed, and emulsified by stirring with a mixer. Thus, a monomer pre-emulsion was prepared.

Next, into an ordinary reaction vessel for producing an acrylic resin emulsion equipped with a stirrer, a thermometer, a dropping funnel, a reflux condenser, a nitrogen inlet tube, and the like, 280 parts by mass of ion-exchanged water, 3.5 parts by mass of LATEMUL PD-104 (manufactured by Kao Chemicals), and an aqueous APS solution (obtained by mixing 0.7 parts by mass of ammonium persulfate APS (manufactured by Aldrich), which was a polymerization initiator, and 7 parts by mass of water with stirring) were introduced, and heated to 80° C. with stirring. Subsequently, to this solution in the reaction vessel, 5% by mass of the total amount of the monomer pre-emulsion was added, and the mixture was held at 80° C. for 10 minutes. After that, the remainder of the monomer pre-emulsion was added dropwise into the reaction vessel over 3 hours with stirring. After completion of the dropwise addition, the reaction was further allowed to proceed by continuing the stirring at 80° C. for 1 hour. After that, 322 parts by mass of ion-exchanged water was added thereto, and the mixture was cooled to room temperature. After the cooling, 40.5 parts by mass of an aqueous 50% by mass dimethylethanolamine solution was added, followed by stirring for 10 minutes. Thus, an acrylic emulsion R-1 having a hydroxyl value of 86 and a non-volatile content of 29% by mass was obtained.

(Synthesis Example 2) Preparation of Acrylic Resin R-2 for Solvent-Based Clear Coating Material First, 235 parts by mass of Solvesso 100 was introduced into an ordinary reaction vessel for producing an acrylic resin equipped with a stirrer, a thermometer, a dropping funnel, a reflux condenser, a nitrogen inlet tube, and the like, and the temperature was raised to 130° C. with stirring.

Next, a mixture of 95 parts by mass of 2-ethylhexyl acrylate, 120 parts by mass of 2-hydroxyethylmethacrylate, 150 parts by mass of styrene, 135 parts by mass of glycidyl methacrylate, and 40 parts by mass of a polymerization initiator ("PERCURE O" manufactured by NOF CORPORATION) was prepared, and the mixture was added dropwise to the reaction vessel with stirring over 3 hours. After completion of the dropwise addition, the reaction was allowed to proceed by continuing the stirring at 130° C. for 1 hour. After that, 10 parts by mass of PERCURE O was added, and the reaction was allowed to proceed by further continuing the stirring at 130° C. for 2 hours, followed by cooling to room temperature. Thus, an acrylic resin R-2 having a hydroxyl value of 94, an epoxy value of 107, and a non-volatile content of 70% by mass was obtained.

(Synthesis Example 3) Preparation of Acrylic Resin R-3 for Solvent-Based Clear Coating Material First, 310 parts by mass of Solvesso 100 was introduced into an ordinary reaction vessel for producing an acrylic resin equipped with a stirrer, a thermometer, a dropping funnel, a reflux condenser, a nitrogen inlet tube, and the like, and the temperature was raised to 130° C. with stirring.

Next, a mixture of 125 parts by mass of butyl methacrylate, 225 parts by mass of 2-ethylhexyl methacrylate, 150 parts by mass of maleic anhydride, 50 parts by mass of Solvesso 100, and 100 parts by mass of PERCURE O (polymerization initiator manufactured by NOF CORPORATION) was prepared, and the mixture was added dropwise into the reaction vessel with stirring over 3 hours. After completion of the dropwise addition, the reaction was allowed to proceed by continuing the stirring at 130° C. for 1 hour. After that, 10 parts by mass of a polymerization initiator ("PERCURE O" manufactured by NOF CORPORATION) was added, and the reaction was allowed to proceed by further continuing the stirring at 130° C. for 2 hours, followed by cooling to 60° C. After the cooling, 4.6 parts by mass of triethylamine and 73.5 parts by mass of methanol were added, and the reaction was allowed to proceed by continuing the stirring at 60° C. for 12 hours, followed by cooling to room temperature. Thus, an acrylic resin R-3 having an acid number of 172 and a non-volatile content of 61% by mass was obtained.

(Synthesis Example 4) Preparation of Acrylic Resin R-4 for Solvent-Based Clear Coating Material First, 195 parts by mass of Solvesso 100 and 65 parts by mass of butyl acetate were introduced into an ordinary reaction vessel for producing an acrylic resin equipped with a stirrer, a thermometer, a dropping funnel, a reflux condenser, a nitrogen inlet tube, and the like, and the temperature was raised to 130° C. with stirring.

Next, a mixture of 162.5 parts by mass of butyl methacrylate, 149.5 parts by mass of 4-hydroxybutyl acrylate, 78 parts by mass of styrene, 260 parts by mass of isobornyl acrylate, 52 parts by mass of a polymerization initiator ("PERCURE O" manufactured by NOF CORPORATION) was prepared, and the mixture was added dropwise to the reaction vessel with stirring over 3 hours. After completion of the dropwise addition, the reaction was allowed to proceed by continuing the stirring at 130° C. for 1 hour. After that, 13 parts by mass of a polymerization initiator ("PERCURE O" manufactured by NOF CORPORATION) was added, and the reaction was allowed to proceed by further continuing the stirring at 130° C. for 2 hours. Then, 75 parts by mass of butylacetate was added, followed by cooling to room temperature. Thus, an acrylic resin R-4 having a hydroxyl value of 90 and a non-volatile content of 65% was obtained.

Preparation Example 1

Preparation of Water-Based Base Coating Material B-1

Into a container, 195.5 parts by mass of the acrylic emulsion R-1 obtained in Synthesis Example 1 was introduced. Then, 22.3 parts by mass of a hydrophilic polyisocyanate ("DURANATE WB40-100" manufactured by Asahi Kasei Chemicals Corporation), 120 parts by mass of ion-exchanged water, and 24 parts by mass of butyl glycol were added thereto with stirring, and the mixture was stirred for 5 minutes. Further, 9.3 parts by mass of an alkali thicker ("Viscalex HV30" manufactured by Ciba Specialty Chemicals), 3.2 parts by mass of dimethylethanolamine, and 5.0 parts by mass of SURFYNOL 104DPM (manufactured by Nissin Chemical Industry Co., Ltd) were added. Thus, a water-based resin liquid was obtained.

Meanwhile, to another container, 24 parts by mass of butyl glycol and 30 parts by mass of an aluminum paste ("Hydrolan 2156" manufactured by ECKART) were added, and then stirred for 1 hour. Thus, an aluminum paste solution was obtained.

Next, to 379.3 parts by mass of the water-based resin solution, 52.9 parts by mass of this aluminum paste solution was added with stirring, and further the mixture was stirred for 1 hour. Thus, a water-based base coating material B-1 having a non-volatile content of 23.7% by mass was obtained. The shrinkage ratio ω' of this water-based base coating material B-1 was 0.5%.

(Preparation Example 2) Preparation of Water-Based Base Coating Material B-2

A water-based base coating material B-2 was obtained in the same manner as in Preparation Example 1, except that the amount of the acrylic emulsion R-1 obtained in Synthesis Example 1 introduced was changed to 271.2 parts by mass, and the amount of DURANATE WB40-100 added was changed to 0 parts by mass. This water-based base coating material B-2 had a non-volatile content of 21.1% by mass and a shrinkage ratio ω' of 1.6%.

(Preparation Example 3) Preparation of Water-Based Base Coating Material B-3

A water-based base coating material B-3 was obtained in the same manner as in Preparation Example 1, except that the amount of the acrylic emulsion R-1 obtained in Synthesis Example 1 introduced was changed to 250.8 parts by mass, and 7.5 parts by mass of a methylated melamine resin ("CYMEL 325" manufactured by Nihon Cytec Industries Inc.) was used instead of DURANATE WB40-100. This water-based base coating material B-3 had a non-volatile content of 21.7% by mass and a shrinkage ratio ω' of 2.0%.

(Preparation Example 4) Preparation of Water-Based Base Coating Material B-4

A water-based base coating material B-4 was obtained in the same manner as in Preparation Example 3, except that the amount of the acrylic emulsion R-1 obtained in Synthesis Example 1 introduced was changed to 230.5 parts by mass, and the amount of CYMEL 325 added was changed to 15 parts by mass. This water-based base coating material 3-4 had a non-volatile content of 22.3% by mass and a shrinkage ratio ω' of 2.6%.

(Preparation Example 5) Preparation of Water-Based Base Coating Material B-5

A water-based base coating material B-5 was obtained in the same manner as in Preparation Example 3, except that the amount of the acrylic emulsion R-1 obtained in Synthesis Example 1 introduced was changed to 210.2 parts by mass, and the amount of CYMEL 325 introduced was changed to 22.5 parts by mass. This water-based base coating material 8-5 had a non-volatile content of 23.0% by mass and a shrinkage ratio ω' of 2.9%.

(Preparation Example 6) Preparation of Water-Based Base Coating Material B-6

A water-based base coating material B-6 was obtained in the same manner as in Preparation Example 3, except that the amount of the acrylic emulsion R-1 obtained in Synthesis Example 1 introduced was changed to 195.5 parts by mass, and the amount of CYMEL 325 introduced was changed to 30 parts by mass. This water-based base coating material B-6 had a non-volatile content of 23.6% by mass and a shrinkage ratio ω' of 3.2%.

(Preparation Example 7) Preparation of Water-Based Base Coating Material B-7

A water-based base coating material B-7 was obtained in the same manner as in Preparation Example 3, except that the amount of the acrylic emulsion R-1 obtained in Synthesis Example 1 introduced was changed to 162.7 parts by mass, and the amount of CYMEL 325 introduced was changed to 40 parts by mass. This water-based base coating material B-7 had a non-volatile content of 24.6% by mass and a shrinkage ratio ω' of 3.6%.

(Preparation Example 8) Preparation of Solvent-Based Clear Coating Material C-1

Into a container, 443.3 parts by mass of the acrylic resin R-2 for solvent-based clear coating material obtained in Synthesis Example 2, 300.3 parts by mass of the acrylic resin R-3 for solvent-based clear coating material obtained in Synthesis Example 3, 123.8 parts by mass of n-butanol, 24.8 parts by mass of Solvesso 100, 14.9 parts by mass of xylene, 39.6 parts by mass of 2-methoxy-1-propanol, 9.9 parts by mass of TINUVIN 123 (manufactured by BASF), 9.9 parts by mass of TINUVIN 384-2 (manufactured by BASF), and 9.9 parts by mass of a tributylammonium bromide solution (a mixture of 0.9 parts by mass of tributylammonium bromide and 9 parts by mass of n-butanol) were introduced. To this mixture, 2.8 parts by mass of BYK-370 (manufactured by BYK-Chmie), 5.2 parts by mass of BYK-306 (manufactured by BYK-Chmie), 5.0 parts by mass of DISPARLON NSH8430 (manufactured by Kusumoto Chemicals, Ltd.), and 1.2 parts by mass of DISPARLON OX883 (manufactured by Kusumoto Chemicals, Ltd.) were added with stirring, followed by stirring for further 10 minutes. Thus, an acid-epoxy curing solvent-based clear coating material C-1 having a non-volatile content of 52% was obtained. This solvent-based clear coating material C-1 had a shrinkage ratio ω' of 1.1%.

(Preparation Example 9) Preparation of Solvent-Based Clear Coating Material C-2

Into a container, 759.3 parts by mass of the acrylic resin R-4 for solvent-based clear coating material obtained in Synthesis Example 4, 197.4 parts by mass of butylacetate, 9.9 parts by mass of TINUVIN 123 (manufactured by BASF), and 9.9 parts by mass of TINUVIN 384-Z (manufactured by BASF) were introduced. To this mixture, 2.8 parts by mass of BYK-370 (manufactured by BYK-Chmie), 5.1 parts by mass of BYK-306 (manufactured by BYK-Chmie), 9.5 parts by mass of BYK-392 (manufactured by BYK-Chmie), 4.9 parts by mass of DISPARLON NSH8430 (Kusumoto Chemicals, Ltd.), 1.2 parts by mass of DISPARLON OX883 (manufactured by Kusumoto Chemicals, Ltd.), and 175 parts by mass of a polyisocyanate ("DURANATE TPA-100" manufactured by Asahi Kasei Chemicals Corporation) were added with stirring, followed by stirring for further 10 minutes. Thus, an isocyanate-curing solvent-based clear coating material C-2 having a non-volatile content of 59% was obtained. This solvent-based clear coating material C-2 had a shrinkage ratio ω' of 0.2%.

Example 1

On a surface of a steel plate (manufactured by Japan Route Service K. K.) subjected to intermediate coating and electrodeposition, the water-based base coating material B-1 (shrinkage ratio ω': 0.5%) obtained in Preparation Example 1 was applied in a film thickness which became 15 μm after baking, and water, the organic solvent, and the like were evaporated by heating at 80° C. for 3 minutes. Subsequently, on this layer of the water-based base coating material B-1, the solvent-based clear coating material C-2 (shrinkage ratio ω': 0.2%) obtained in Preparation Example 9 was applied in a film thickness which became 35 μm after baking. Thus, an uncured laminated coating film was obtained in which the water-based base coating material B-1 and the solvent-based clear coating material C-2 were applied using a wet-on-wet technique.

After this uncured laminated coating film was allowed to stand (flashed) at room temperature for 10 minutes, the uncured laminated coating film was subjected to a heat treatment (baking treatment) at 140° C. for 30 minutes to cause the curing reaction. Thus, the layers were cured, and a laminated coating film was obtained.

The obtained laminated coating film was measured for wave scan values [du (wavelength<0.1 mm), Wa (wavelength: 0.1 to 0.3 mm), Wb (wavelength: 0.3 to 1 mm), Wc (wavelength: 1 to 3 mm), Wd (wavelength: 3 to 10 mm), and We (wavelength: 10 to 30 mm)] by using a wave scan ("Wave-Scan Dual" manufactured by BYK-Gardner). Table 1 shows the results. Regarding these wave scan values, a smaller value means that the surface of the upper layer has less unevenness corresponding to the wavelengths, and is better in an appearance quality. Here, a smaller du or Wa means better gloss, and a smaller Wd or We means better surface texture. Note that the required appearance quality is 25 or less in terms of Wa.

In addition, the absolute value |Δω'| of the difference between the shrinkage ratio of the water-based base coating material (lower layer-coating material) and the shrinkage ratio of the solvent-based clear coating material (upper layer-coating material) was 0.3% at the late stage of the baking in the baking step.

Example 2

A laminated coating film was obtained in the same manner as in Example 1, except that the water-based base coating material B-2 (shrinkage ratio ω': 1.6%) obtained in Preparation Example 2 was used instead of the water-based base coating material B-1, and that the solvent-based clear coating material C-1 (shrinkage ratio ω': 1.1%) obtained in Preparation Example 8 was used instead of the solvent-based clear coating material C-2. The obtained laminated coating film was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 0.5% at the late stage of the baking in the baking step.

Example 3

A laminated coating film was obtained in the same manner as in Example 1, except that the solvent-based clear coating material C-1 (shrinkage ratio ω': 1.1%) obtained in Preparation Example 8 was used instead of the solvent-based clear coating material C-2. The obtained laminated coating film was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 0.6% at the late stage of the baking in the baking step.

Example 4

A laminated coating film was obtained in the same manner as in Example 1, except that the water-based base coating material B-3 (shrinkage ratio ω': 2.0%) obtained in Preparation Example 3 was used instead of the water-based base coating material B-1, and that the solvent-based clear coating material C-1 (shrinkage ratio ω': 1.1%) obtained in Preparation Example 8 was used instead of the solvent-based clear coating material C-2. The obtained laminated coating film was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 0.9% at the late stage of the baking in the baking step.

Example 5

A laminated coating film was obtained in the same manner as in Example 1, except that the water-based base coating material B-4 (shrinkage ratio ω': 2.6%) obtained in Preparation Example 4 was used instead of the water-based base coating material B-1, and that the solvent-based clear coating material C-1 (shrinkage ratio ω': 1.1%) obtained in Preparation Example 8 was used instead of the solvent-based clear coating material C-2. The obtained laminated coating film was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 1.5% at the late stage of the baking in the baking step.

Example 6

A laminated coating film was obtained in the same manner as in Example 1, except that the water-based base coating material B-5 (shrinkage ratio ω': 2.9%) obtained in Preparation Example 5 was used instead of the water-based base coating material B-1, and that the solvent-based clear coating material C-1 (shrinkage ratio ω': 1.1%) obtained in Preparation Example 8 was used instead of the solvent-based clear coating material C-2. The obtained laminated coating film was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 1.8% at the late stage of the baking in the baking step.

Example 7

A laminated coating film was obtained in the same manner as in Example 1, except that the water-based base coating material B-3 (shrinkage ratio ω': 2.0%) obtained in Preparation Example 3 was used instead of the water-based base coating material B-1. The obtained laminated coating film was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 1.8% at the late stage of the baking in the baking step.

Comparative Example 1

A laminated coating film for comparison was obtained in the same manner as in Example 1, except that the water-based base coating material B-6 (shrinkage ratio ω': 3.2%) obtained in Preparation Example 6 was used instead of the water-based base coating material B-1, and that the solvent-based clear coating material C-1 (shrinkage ratio ω': 1.1%) obtained in Preparation Example 8 was used instead of the solvent-based clear coating material C-2. The obtained laminated coating film for comparison was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 2.1% at the late stage of the baking in the baking step.

Comparative Example 2

A laminated coating film for comparison was obtained in the same manner as in Example 1, except that the water-based base coating material B-7 (shrinkage ratio ω': 3.6%) obtained in Preparation Example 7 was used instead of the water-based base coating material B-1, and the solvent-based clear coating material C-1 (shrinkage ratio ω': 1.1%) obtained in Preparation Example 8 was used instead of the solvent-based clear coating material C-2. The obtained laminated coating film for comparison was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 2.5% at the late stage of the baking in the baking step.

Comparative Example 3

A laminated coating film for comparison was obtained in the same manner as in Example 1, except that the water-based base coating material B-6 (shrinkage ratio ω': 3.2%) obtained in Preparation Example 6 was used instead of the water-based base coating material B-1. The obtained laminated coating film for comparison was measured for du and Wa to We in the same manner as in Example 1. Table 1 shows the results. Note that the absolute value |Δω'| of the difference between the shrinkage ratio of the water-based base coating material (lower layer-coating material) and the shrinkage ratio of the solvent-based clear coating material (upper layer-coating material) was 3.0% at the late stage of the baking in the baking step.

TABLE 1

| | Base coating material | Clear coating material | \|Δω'\| | du | Wa | Wb | Wc | Wd | We |
|---|---|---|---|---|---|---|---|---|---|
| Example 1 | B-1 | C-2 | 0.3 | 27.8 | 17.2 | 13.5 | 10.2 | 13.4 | 9.5 |
| Example 2 | B-2 | C-1 | 0.5 | 29.4 | 15.1 | 12.3 | 9.0 | 16.7 | 10.5 |
| Example 3 | B-1 | C-1 | 0.6 | 28.2 | 16.0 | 16.4 | 8.5 | 10.9 | 5.7 |
| Example 4 | B-3 | C-1 | 0.9 | 29.3 | 12.9 | 12.0 | 10.9 | 16.0 | 8.0 |
| Example 5 | B-4 | C-1 | 1.5 | 35.8 | 15.9 | 19.5 | 11.1 | 16.7 | 6.4 |
| Example 6 | B-5 | C-1 | 1.8 | 36.3 | 24.2 | 19.9 | 11.0 | 15.8 | 9.4 |
| Example 7 | B-3 | C-2 | 1.8 | 28.9 | 19.5 | 20.5 | 9.0 | 6.8 | 4.7 |
| Comp. Ex. 1 | B-6 | C-1 | 2.1 | 42.2 | 30.6 | 24.9 | 16.0 | 20.3 | 14.1 |
| Comp. Ex. 2 | B-7 | C-1 | 2.5 | 39.5 | 32.0 | 28.1 | 16.0 | 20.4 | 15.2 |
| Comp. Ex. 3 | B-6 | C-2 | 3.0 | 42.5 | 32.3 | 28.2 | 16.8 | 20.7 | 14.8 |

Here, the laminated coating films (Examples 1 to 7) were formed in such a manner that the uncured laminated coating film was obtained by using thermosetting coating materials for both the lower layer and the upper layer and applying the thermosetting coating materials using a wet-on-wet technique, and the uncured laminated coating film was then subjected to a baking treatment, as described in the present invention, with the absolute values |Δω'| of the difference between the shrinkage ratio of the water-based base coating material (lower layer-coating material) and the shrinkage ratio of the solvent-based clear coating material (upper layer-coating material) being within the range of 2.0 or smaller at the late stage of the baking. Meanwhile, the conventional laminated coating films (Comparative Examples 1 to 3) had the absolute values |Δω'| exceeding 2.0. As is apparent from the results shown in Table 1, it was found that the laminated coating films (Examples 1 to 7) had smaller du and Wa to Wd values than the conventional laminated coating films (Comparative Examples 1 to 3), and were very excellent in appearance qualities. Specifically, there was a tendency that the du and Wa to We values decreased with the decrease in the |Δω'|. The Wa of each of the coating films in which the lower layer-coating material and the upper layer-coating material were applied using a wet-on-wet technique with the |Δω'| being 2.0% or smaller as described in the present invention was 25 or less, and satisfied the required appearance quality. In contrast, it was found that the Wa of each of the laminated coating films of Comparative Examples (Comparative Examples 1 to 3), in which the lower layer-coating material and the upper layer-coating material were applied using a wet-on-wet technique with the |Δω'| being larger than 2.0%, exceeded 25, and did not satisfy the required appearance quality.

As described above, it has been found that a laminated coating film having very excellent appearance qualities can be obtained when two kinds of coating materials are applied using a wet-on-wet technique, and the absolute value of a difference in shrinkage ratio between the lower layer-coating material and the upper layer-coating material is 2.0% or smaller at the late stage of the baking in the baking step.

INDUSTRIAL APPLICABILITY

As has been described above, according to the present invention, a laminated coating film having an upper layer in which formation of surface unevenness is sufficiently suppressed can be obtained, even when two kinds of coating materials are applied using a wet-on-wet technique and simultaneously baked to cure the layers. This makes it possible to obtain a coated article having very excellent appearance qualities such as surface texture (surface smoothness) and gloss.

Accordingly, the present invention is useful as a coating method which makes it possible to obtain a coated article having very excellent appearance qualities, even when two kinds of coating materials are applied using a wet-on-wet technique and then simultaneously baked. The present invention is especially useful as a method for coating vehicle bodies and parts for automobiles such as passenger cars, trucks, buses, and motorcycles.

The invention claimed is:

1. A coating method for forming a laminated coating film including a lower layer formed on a base material and an upper layer formed on the lower layer, the coating method comprising:

a preparation step of preparing a thermosetting coating material as a lower layer-coating material for forming the lower layer and preparing a thermosetting coating material as an upper layer-coating material for forming the upper layer;

a formation step of forming an uncured laminated coating film by applying the lower layer-coating material and the upper layer-coating material on the base material using a wet-on-wet technique; and a baking step of simultaneously curing the lower layer-coating material and the upper layer-coating material by subjecting the uncured laminated coating film to a baking treatment, wherein in the preparation step, the lower layer-coating material and the upper layer-coating material are selected so that an absolute value of a difference in shrinkage ratio between the lower layer-coating material and the upper layer-coating material is 1.0% or smaller at a late stage of the baking in the baking step, said late stage of the baking being a period after a preliminary drying state in which water has been removed by drying the coating film made of the coating material at 80° C. for 3 hours and then in a vacuum at 60° C. for 96 hours, up to a completion state of the baking in which the coating film has been baked at 140° C. for 30 minutes, each of the upper layer-coating material and the lower layer-coating material contains a thermosetting resin and a curing agent, a combination of the thermosetting resin and the curing agent in the upper layer-coating material is a combination selected from the group consisting of a combination of a hydroxy group-containing acrylic resin and an isocyanate compound, a combination of a hydroxy group-containing acrylic resin and an isocyanate resin, and a combination of a hydroxy group and glycidyl group-containing acrylic resin and a carboxyl group-containing acrylic resin, and a combination of the thermosetting resin and the curing agent in the lower layer-coating material is a combination selected from the group consisting of a combination of an acrylic resin and a melamine resin, a combination of a polyester resin and a melamine resin, a combination of an acrylic resin and a (block) isocyanate compound, and a combination of a polyester resin and a (block) isocyanate compound.

2. The coating method according to claim 1, wherein the upper layer-coating material has a shrinkage ratio in a range from 0 to 20% at the late stage of the baking in the baking step, and the lower layer-coating material has a shrinkage ratio in a range from 0 to 20% at the late stage of the baking in the baking step.

3. The coating method according to claim 1, wherein the upper layer-coating material is a coating material containing no melamine resin as a curing agent.

4. The coating method according to claim 1, wherein the upper layer-coating material is a thermosetting coating material from which no volatile product is formed in a curing reaction by a heat treatment.

5. The coating method according to claim 1, wherein the upper layer-coating material is a clear coating material, and the lower layer-coating material is a base coating material.

* * * * *